US011129470B2

(12) United States Patent
Lin

(10) Patent No.: US 11,129,470 B2
(45) Date of Patent: Sep. 28, 2021

(54) HEIGHT ADJUSTABLE TABLE

(71) Applicant: Dongguan Shichang Metals Factory Ltd., DongGuan (CN)

(72) Inventor: Chen-Kang Lin, DongGuan (CN)

(73) Assignee: Dongguan Shichang Metals Factory Ltd., DongGuan (CN)

( * ) Notice: Subject to any disclaimer, the term of this patent is extended or adjusted under 35 U.S.C. 154(b) by 0 days.

(21) Appl. No.: 16/869,069

(22) Filed: May 7, 2020

(65) Prior Publication Data

US 2020/0305595 A1 Oct. 1, 2020

Related U.S. Application Data

(63) Continuation-in-part of application No. 16/823,890, filed on Mar. 19, 2020, now Pat. No. 11,039,683.

(30) Foreign Application Priority Data

Mar. 28, 2019 (CN) ..... 201910241492.6
Mar. 28, 2019 (CN) ..... 201920406499.4

(51) Int. Cl.
*A47B 13/08* (2006.01)
*A47B 9/20* (2006.01)
(Continued)

(52) U.S. Cl.
CPC ..... *A47B 13/081* (2013.01); *A47B 3/00* (2013.01); *A47B 7/02* (2013.01); *A47B 9/20* (2013.01)

(58) Field of Classification Search
CPC ..... A47B 13/081; A47B 13/003; A47B 3/00; A47B 7/02
See application file for complete search history.

(56) References Cited

U.S. PATENT DOCUMENTS 2,817,548 A 12/1957 Wolfgang
4,818,135 A 4/1989 Desjardins
(Continued)

FOREIGN PATENT DOCUMENTS

GB 2446570 A 8/2008

OTHER PUBLICATIONS

European Search Report from EP App. No. 20165711.1, dated May 14, 2020, 7 pages.

*Primary Examiner* — Daniel J Rohrhoff
(74) *Attorney, Agent, or Firm* — Luedeka Neely Group, P.C.

(57) ABSTRACT

A table has a tabletop, a vertical support, and a mounting frame disposed at a top end of the vertical support and attached to the tabletop. The mounting frame includes a fixing base, a rotating frame rotatably connected to the fixing base, and a rotating handle assembly rotatably connected to the rotating frame. The rotating frame is operable to rotate between a horizontal position and a vertical position. The rotating handle assembly includes an abutting block that engages the lower embedding notch in the fixing base when the rotating frame is in the horizontal position. The rotating handle assembly has a lower edge that engages the upper embedding notch in the fixing base when the rotating frame is in the vertical position. A handle, which extends outwardly from the rotating handle assembly, is configured to be operated by a user to move the rotating frame between the vertical position and the horizontal position.

6 Claims, 9 Drawing Sheets

(51) Int. Cl.
*A47B 3/00* (2006.01)
*A47B 7/02* (2006.01)

(56) References Cited

U.S. PATENT DOCUMENTS

| | | | | | |
|---|---|---|---|---|---|
| 5,121,697 | A * | 6/1992 | Baum | A47B 3/0803 | 108/124 |
| 5,354,027 | A * | 10/1994 | Cox | A47B 3/0815 | 108/115 |
| 6,662,731 | B2 * | 12/2003 | Teppo | A47B 3/0818 | 108/6 |
| 7,614,351 | B2 * | 11/2009 | Piretti | A47B 3/0815 | 108/1 |
| 8,297,208 | B2 * | 10/2012 | Hoffman | A47B 13/08 | 108/133 |
| 8,413,594 | B2 * | 4/2013 | Ensley | A47B 3/0815 | 108/132 |
| 9,144,300 | B2 * | 9/2015 | Cotey | A47B 3/0815 | |
| 10,051,960 | B1 * | 8/2018 | Siebert | A47B 85/04 | |
| 10,206,494 | B1 * | 2/2019 | Gretscher | A47B 3/0818 | |
| 10,595,630 | B2 * | 3/2020 | Lam | A47B 3/0818 | |
| 10,631,629 | B2 * | 4/2020 | Hung | A47B 3/083 | |
| 10,654,315 | B1 * | 5/2020 | Kamrowski | B60B 33/0002 | |
| 2009/0283020 | A1 * | 11/2009 | Hsu | A47B 3/0815 | 108/115 |
| 2014/0241789 | A1 | 8/2014 | Chiu | | |
| 2019/0365091 | A1 * | 12/2019 | Ruzicka | A47B 13/081 | |
| 2020/0305594 | A1 * | 10/2020 | Lin | A47B 9/10 | |
| 2021/0068531 | A1 * | 3/2021 | Tao | A47B 3/08 | |

* cited by examiner

HEIGHT ADJUSTABLE TABLE

RELATED APPLICATIONS

This application is a continuation-in-part of U.S. patent application Ser. No. 16/823,890, titled "Height Adjustable Table," which is based on and claims the benefit of priority from Chinese Patent Application No. 2019102414926, filed on Mar. 28, 2019, the entirety of which is incorporated by reference herein.

FIELD

This invention relates to the field tables, and in particular to a height adjustment mechanism for a height adjustable table.

BACKGROUND

In typical height adjustable tables, a gas spring is generally used to drive an inner sleeve to slide vertically within an outer sleeve. After the gas spring is driven, original air pressure is generally used to hold the table height at a fixed position. However, if the air is discharged, this may result in instability of the table and affect its use.

SUMMARY

The present disclosure provides a height adjustment mechanism and a table that address the technical problems in the prior art. The working state of the height adjustment mechanism can be locked to ensure normal use of the table.

According to a first aspect of the present disclosure, a height adjustment mechanism is provided, including an outer sleeve, an inner sleeve, a plug, and a locking mechanism. The outer sleeve is disposed outside the inner sleeve, and the outer sleeve and the inner sleeve are relatively slidable. The plug is disposed outside the inner sleeve and is slidably connected to the inner sleeve. The plug is disposed at an upper end of the outer sleeve, and an outer wall of the plug includes a pressing portion. The locking mechanism is used to press the pressing portion tightly against an outer wall of the inner sleeve.

The present disclosure has the following beneficial effects. The locking mechanism presses the pressing portion against the outer wall of the inner sleeve to increase the friction between the plug and the inner sleeve, so that the plug and the inner sleeve are relatively fixed. The plug is disposed at the upper end of the outer sleeve, and when the plug abuts against a top end of the outer sleeve, the entire height adjustment mechanism can be locked. This ensures that the outer sleeve and the inner sleeve are prevented from continuing to slide relative to each other, and the table is steady and stable and normal use thereof is ensured.

In the height adjustment mechanism according to the first aspect of the present disclosure, the plug is embedded in the outer sleeve, the outer sleeve includes a concave hole, the locking mechanism includes a cam that is extended into the concave hole and presses the pressing portion to make the pressing portion abut against the inner sleeve. The plug is embedded in the outer sleeve to fix the positions of the plug and the outer sleeve relative to each other, the pressing portion is then aligned with the concave hole, and the cam extends into the concave hole to press the pressing portion tightly.

In the height adjustment mechanism according to the first aspect of the present disclosure, the outer sleeve includes a cam base, and the cam is rotatably connected to the cam base. The cam is rotated to enable the height adjustment mechanism to switch between a locked state and a movable state.

In the height adjustment mechanism according to the first aspect of the present disclosure, the outer sleeve is fixedly connected to the plug by a fastener, such as a pin or screw. The plug is fixed on the outer sleeve to prevent the plug from moving as the inner sleeve retracts, so that it can be ensured that the relative position between the plug and the outer sleeve is fixed to facilitate use.

In the height adjustment mechanism according to the first aspect of the present disclosure, a plurality of protrusions are provided at an inner side surface of the plug, and a plurality of grooves are provided at the surface of the inner sleeve for accommodating the protrusions. The protrusions are embedded in the grooves and slide in the grooves to guide the inner sleeve, thereby preventing relative rotation between the inner sleeve and the plug to reduce shaking.

In the height adjustment mechanism according to the first aspect of the present disclosure, at least one guide sleeve is disposed between the inner sleeve and the outer sleeve, and the guide sleeve disposed at the lowest end is fixedly connected to a lower end of the inner sleeve. The guide sleeve is disposed between the inner sleeve and the outer sleeve to prevent friction there between, so as to protect the surface of the inner sleeve and facilitate the slide of the inner sleeve in the outer sleeve.

In the height adjustment mechanism according to the first aspect of the present disclosure, the guide sleeve includes a plurality of through holes in which a plurality of ball bearings are embedded, and the ball bearings abut against the inner sleeve and the outer sleeve. The ball bearings convert sliding friction into rolling friction to reduce the overall friction. In addition to rolling in the holes, the ball bearings can also move inward or outward in the holes when being elastically compressed, thereby avoiding hindered and unsmooth sliding caused by insufficient roundness or uneven thickness of the outer sleeve when the inner sleeve moves in the outer sleeve. The roundness herein is defined as a radial offset of an actual contour relative to a perfect circle, that is, a difference between a maximum radius and a minimum radius relative to the same center of circle.

The height adjustment mechanism according to the first aspect of the present disclosure further includes a base and a mounting frame, wherein the base is fixed at a bottom end of the outer sleeve, the mounting frame is fixed at a top end of the inner sleeve, a gas spring is disposed inside the inner sleeve, and two ends of the gas spring are separately fixed on the mounting frame and the base. The gas spring supplies lifting force to the inner sleeve.

In the height adjustment mechanism according to the first aspect of the present disclosure, the mounting frame includes a fixing base, a rotating frame, and a rotating handle assembly. The fixing base is fixed at the top end of the inner sleeve, an end of the rotating frame is rotatably connected to the fixing base, and an end of the rotating handle assembly is rotatably connected to a free end of the rotating frame. The fixing base includes a concave portion in which a free end of the rotating handle assembly is inserted to fix the position of the rotating handle assembly. The rotating frame is vertically disposed when the rotating handle assembly is inserted in the concave portion.

A second aspect of the present disclosure provides a table that includes any of the height adjustment mechanisms.

The present disclosure has the following beneficial effects. The locking mechanism presses the pressing portion against the outer wall of the inner sleeve to increase the friction between the plug and the inner sleeve, so that the plug and the inner sleeve are relatively fixed. The plug is disposed at the upper end of the outer sleeve, and when the plug abuts against a top end of the outer sleeve, the entire height adjustment mechanism can be locked to ensure that the outer sleeve and the inner sleeve are prevented from sliding relative to each other. This ensures that the table is steady and stable in normal use.

According to an alternative embodiment, the present disclosure provides a table having a tabletop, a vertical support disposed below the tabletop, and a mounting frame disposed at a top end of the vertical support and attached to a lower surface of the tabletop. The mounting frame includes a fixing base, a rotating frame that is attached to the lower surface of the tabletop and is rotatably connected to the fixing base, and a rotating handle assembly that is rotatably connected to the rotating frame. The fixing base has an upper embedding notch and a lower embedding notch. The rotating frame is operable to rotate between a horizontal position and a vertical position.

The rotating handle assembly includes an abutting block that extends inwardly from the rotating handle assembly and engages the lower embedding notch in the fixing base when the rotating frame is in the horizontal position. The rotating handle assembly has a lower edge that engages the upper embedding notch in the fixing base when the rotating frame is in the vertical position. A handle, which extends outwardly from the rotating handle assembly, is configured to be operated by a user to move the rotating frame between the vertical position and the horizontal position.

In some embodiments, the rotating handle assembly includes a torsion spring disposed at a connection between the rotating handle assembly and the rotating frame. The torsion spring urges the abutting block into engagement with the lower embedding notch when the rotating frame is in the horizontal position, and urges the lower edge of the rotating handle assembly into engagement with the upper embedding notch when the rotating frame is in the vertical position.

In some embodiments, a bumper is attached to the fixing base to prevent damage to an adjacent vertically-disposed tabletop when multiple tables are stored together in close proximity with their tabletops rotated to vertical positions.

In some embodiments, an aperture is provided in the rotating handle assembly for receiving the bumper when the abutting block is engaged with the lower embedding notch in the fixing base.

In some embodiments, one or more stop pins are disposed on the fixing base for engaging one or more corresponding notches on a bottom edge of the rotating frame. The stop pins prevent the rotating frame from rotating beyond the horizontal position.

BRIEF DESCRIPTION OF THE DRAWINGS

Other embodiments of the invention will become apparent by reference to the detailed description in conjunction with the figures, wherein elements are not to scale so as to more clearly show the details, wherein like reference numbers indicate like elements throughout the several views, and wherein.

Figure 2:
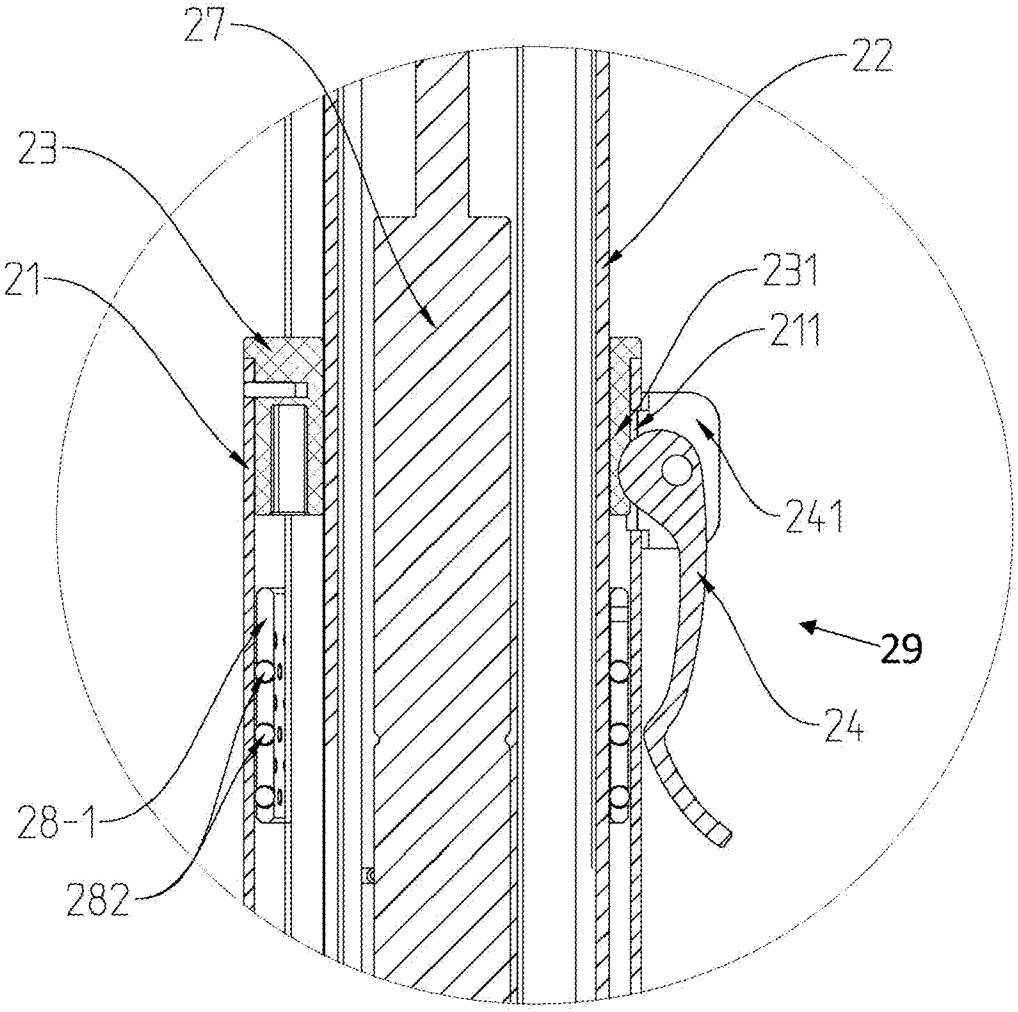
FIG. 2 is a schematic structural diagram of a height adjustment mechanism according to an embodiment of the present disclosure.

REFERENCE NUMERALS tabletop 10;
height adjustment mechanism 20;
outer sleeve 21;
concave hole 211;
inner sleeve 22;
groove 221;
plug 23;
pressing portion 231;
protrusion 232;
cam 24;
cam base 241;
base 25;
mounting frame 26;
rotating frame 261;
fixing base 262;
concave portion 2621;
lower embedding notch 2622;
upper embedding notch 2623;
rotating handle assembly 263;
abutting block 2631;
torsion spring 2632;
bumper aperture 2633;
U-shaped handle 2634;
bumper 264;
stop pin 265;
gas spring 27;
guide sleeve 28;

through hole 281;
ball bearing 282; and
locking mechanism 29.

DETAILED DESCRIPTION

Specific embodiments of the present disclosure are described in detail herein. Preferred embodiments are shown in the accompanying drawings which supplement the textual description in the specification for intuitive and visual understanding of each technical feature and the overall technical solution of the present disclosure, but shall not be understood as a limitation to the scope of the present disclosure.

In the description of the present disclosure, it should be understood that orientation and position relationships indicated by "up," "down," "front," "rear," "left," "right," and the like are based on orientation or location relationships shown in the accompanying drawings, and are used only to facilitate and simplify the description of the present disclosure, but are not used to indicate or imply that the apparatuses or elements must have specific orientations, or are constructed and operated by using specific orientations, and therefore, cannot be understood as a limitation to the present disclosure.

In the description of the present disclosure, the terms "first" and "second" as used herein are for distinguishing technical features, but are not intended to indicate or imply relative importance or implicitly specify a quantity of indicated technical features or implicitly specify an order of indicated technical features.

Unless otherwise expressly defined in the description of the present disclosure, terms such as "disposed," "mounted," and "connected" should be understood in a broad sense. For persons of ordinary skill in the art, specific meanings of the terms in the present disclosure may be appropriately determined with reference to the specific content in the technical solution.

Figure 1:
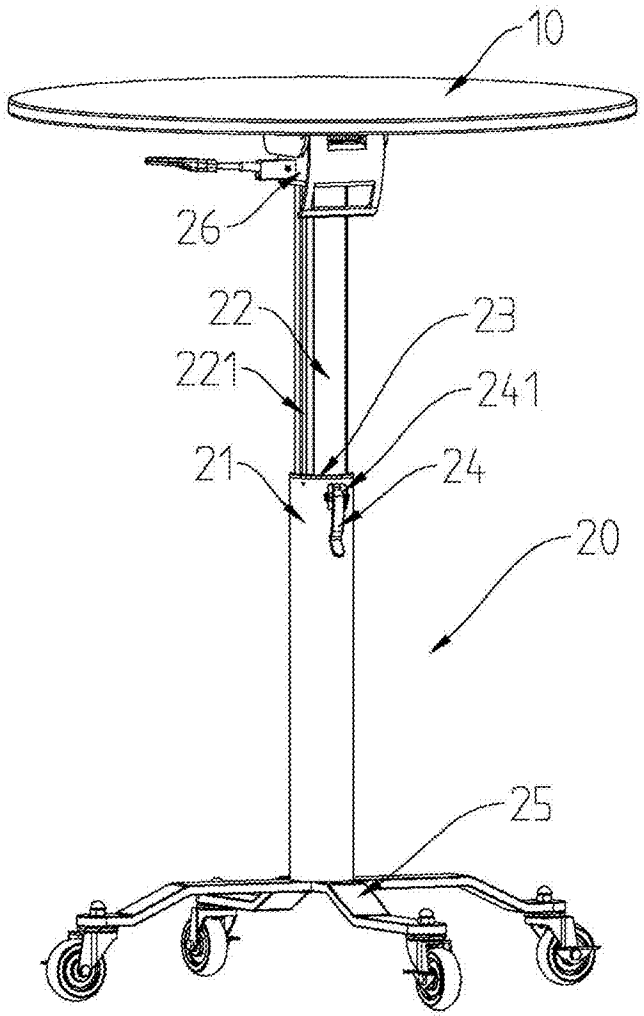
FIG. 1 is a schematic structural diagram of a table according to an embodiment of the present disclosure.

Referring to FIG. 1, a table of a preferred embodiment of the present disclosure includes a tabletop 10 and a height adjustment mechanism 20. The table in the present disclosure may be any of various types of tables such as a dinner table, a desk, a conference table, a coffee table, a bar table, and a training table.

Figure 3:
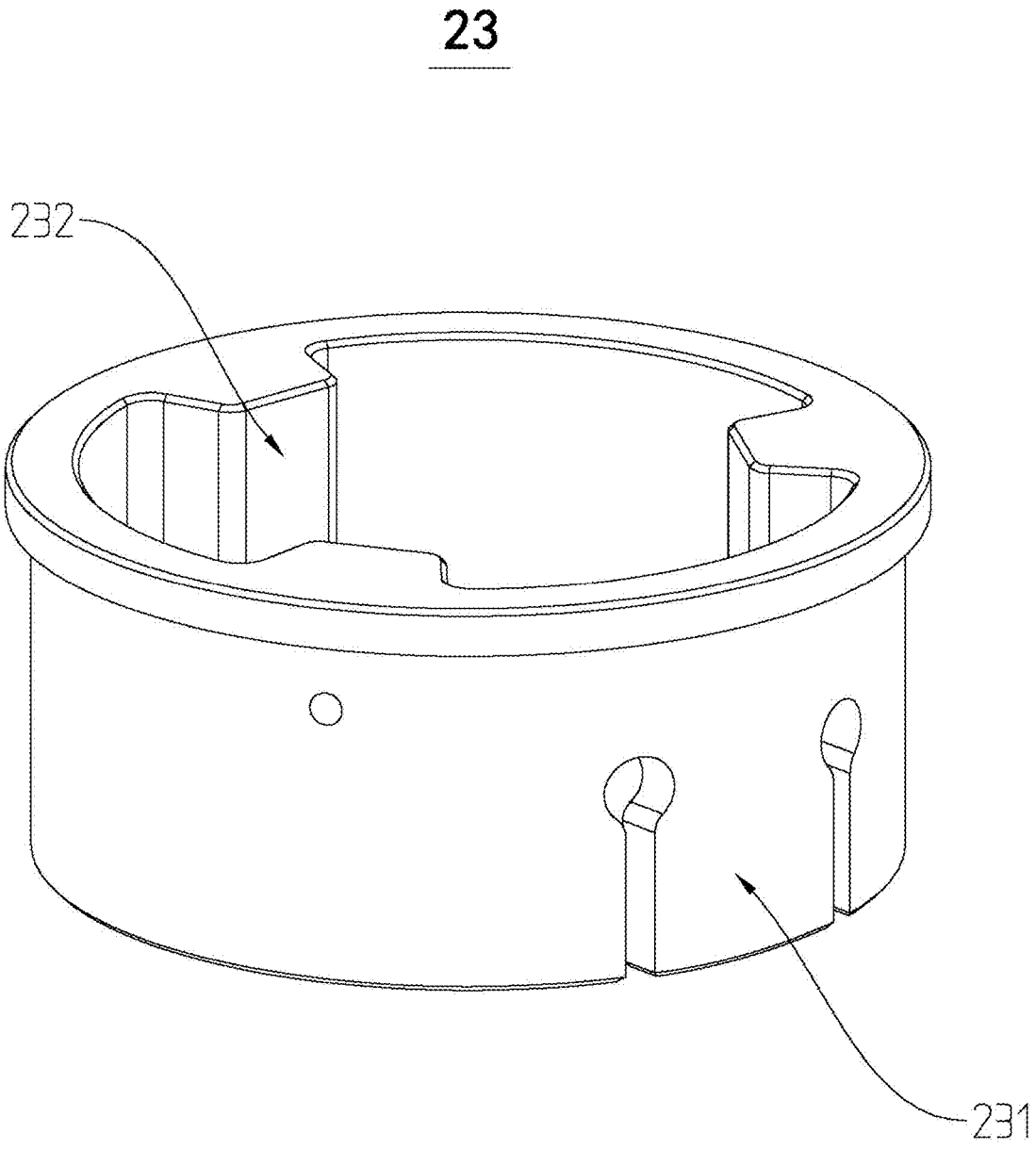
FIG. 3 is a schematic structural diagram of a plug according to an embodiment of the present disclosure.

Referring to FIG. 2 and FIG. 3, the height adjustment mechanism 20 in this embodiment of the present disclosure includes an outer sleeve 21, an inner sleeve 22, a plug 23, and a locking mechanism 29. The outer sleeve 21 is disposed outside the inner sleeve 22, and the outer sleeve 21 and the inner sleeve 22 are relatively slidable. The plug 23 is disposed outside the inner sleeve 22, and slidably engages the inner sleeve 22. The plug 23 is disposed at an upper end of the outer sleeve 21, and an outer wall of the plug 23 includes a pressing portion 231. The locking mechanism 29 is used to urge the pressing portion 231 tightly against an outer wall of the inner sleeve 22.

Referring to the embodiment of FIG. 3, the plug 23 is made of plastic, and the outer wall of the plug 23 includes two vertical grooves that separate a left side and a right side of the pressing portion 231 from the outer wall. An upper side of the pressing portion 231 is connected to the outer wall, and a connecting portion forms a rotating fulcrum for the pressing portion 231, to enable the pressing portion 231 to move with respect to the outer wall.

During use, the locking mechanism 29 urges the pressing portion 231 against the outer wall of the inner sleeve 22 to increase the friction between the plug 23 and the inner sleeve 22, so that the plug 23 and the inner sleeve 22 are relatively fixed. The plug 23 is disposed at the upper portion of the outer sleeve 21 and abuts against a top end of the outer sleeve 21. The relative position between the plug 23 and the outer sleeve 21 is fixed, and therefore the entire height adjustment mechanism 20 can be locked, so that it is ensured that the outer sleeve 21 and the inner sleeve 22 are kept from continuing to slide relative to each other, thereby ensuring that the table is steady and stable during normal use.

In some embodiments, the plug 23 may be embedded in the outer sleeve 21, and the outer sleeve 21 includes a concave hole 211. In such embodiments, the locking mechanism 29 includes a cam 24 that is extendable into the concave hole 211 to urge the pressing portion 231 to press against the inner sleeve 22.

Referring to FIG. 1 and FIG. 2, in a specific implementation, the outer sleeve 21 includes a cam base 241. The cam base 241 includes stop blocks disposed on two sides of the concave hole 211, and the cam 24 is rotatably connected to the stop blocks. When the entire height adjustment mechanism 20 needs to be locked, the cam 24 presses the pressing portion 231 which causes the pressing portion 231 to press the inner sleeve 22 tightly, thereby increasing the friction. When the inner sleeve 22 needs to be raised or lowered, the cam 24 is rotated to reduce the friction between the pressing portion 231 and the inner sleeve 22, so as to enable the inner sleeve 22 and the plug 23 to be relatively slidable.

It should be noted that in another implementation, the cam 24 is replaced by a set screw that engages with the concave hole 211 through threads. When the entire height adjustment mechanism 20 needs to be locked, the set screw is screwed into the inner sleeve 22 and presses the pressing portion 231 tightly against the inner sleeve 22. When the inner sleeve 22 needs to be raised or lowered, the set screw is screwed out to release the pressing portion 231 and the inner sleeve 22.

Referring to FIG. 2, in a specific implementation, the outer sleeve 21 is fixedly connected to the plug 23 by a fastener, such as a pin or screw, to prevent the plug 23 from moving as the inner sleeve 22 extends and retracts. This ensures that the relative position between the plug 23 and the outer sleeve 21 is fixed to facilitate use.

Figure 6:
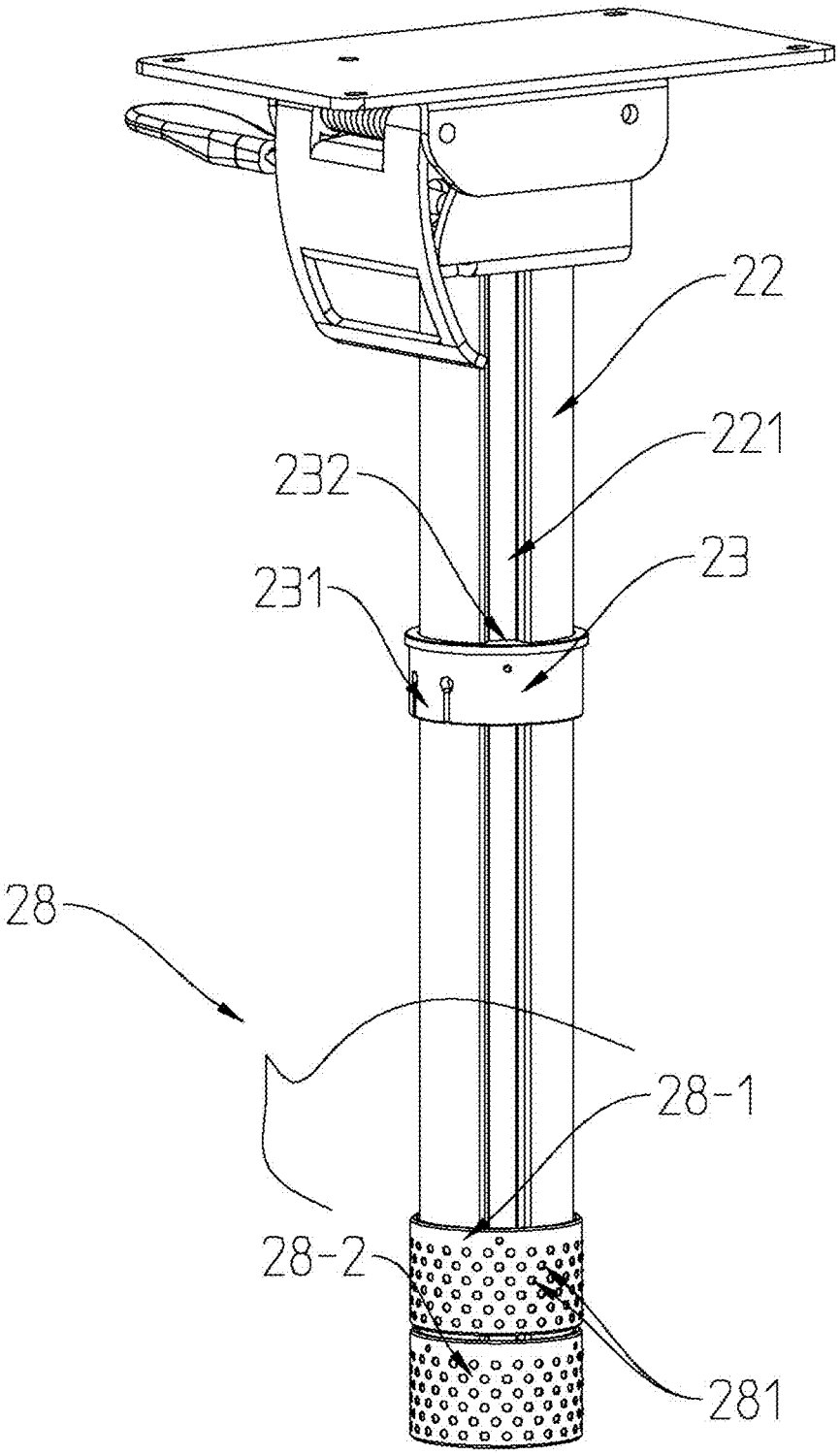
FIG. 6 is a schematic structural diagram of an inner sleeve, a guide sleeve, and a plug according to an embodiment of the present disclosure.

Referring to FIG. 6, a plurality of protrusions 232 are provided at an inside surface of the plug 23, and a plurality of grooves 221 are provided in the outer surface of the inner sleeve 22 for accommodating the protrusions 232. The protrusions 232 are embedded in the grooves 221 and slide in the grooves 221 to guide the inner sleeve 22, thereby preventing relative rotation between the inner sleeve 22 and the plug 23.

As shown in FIG. 3, three protrusions 232 are evenly disposed around the perimeter of the inside surface of the plug 23. When engaged with the inner sleeve 22, the plug 23 can bear more balanced force, thereby making the height adjustment mechanism 20 more stable. One skilled in the art will appreciate that more or fewer than three protrusions 232 may be provided in other embodiments.

Figure 4:
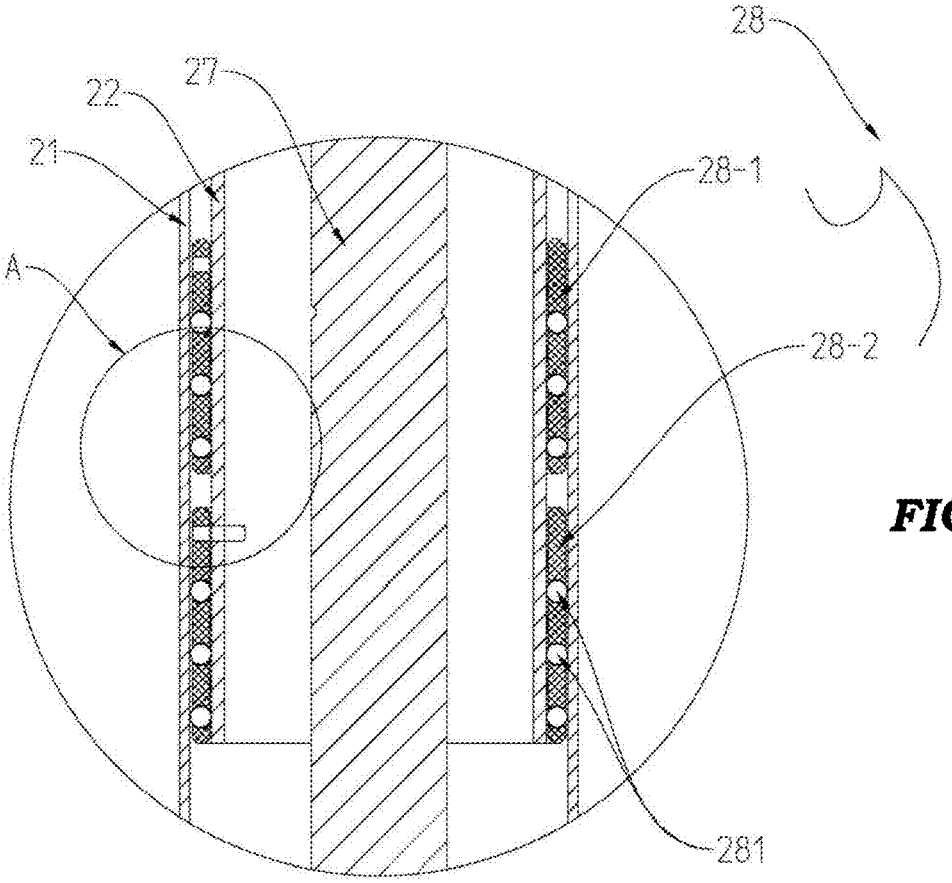
FIG. 4 is a schematic structural diagram of a guide sleeve, an outer sleeve, and an inner sleeve.
Figure 5:
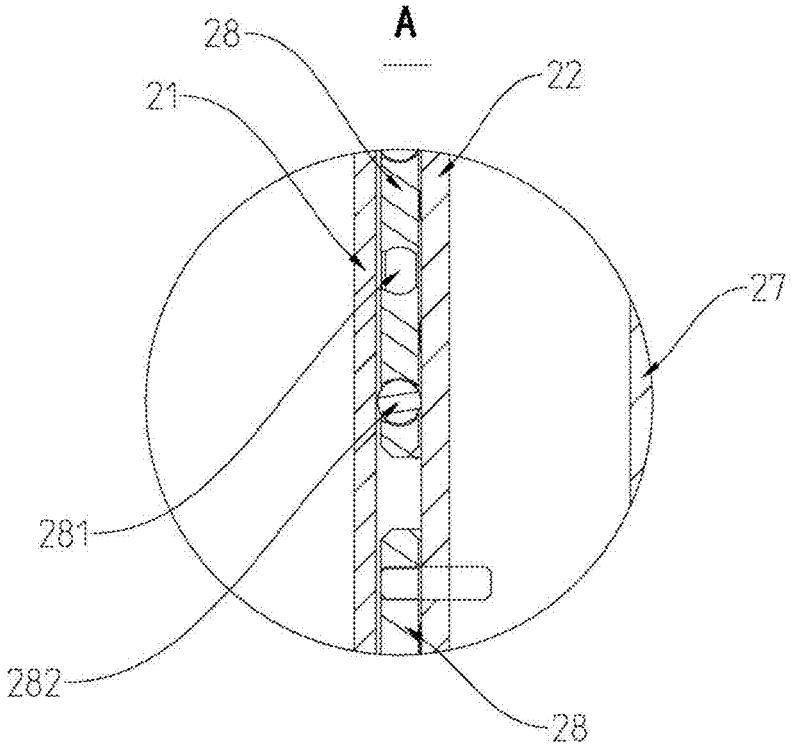
FIG. 5 is a partial schematic diagram of a portion depicted in FIG. 4 according to an embodiment of the present disclosure.

In a specific implementation depicted in FIG. 4 and FIG. 5, at least one guide sleeve 28 is disposed between the inner sleeve 22 and the outer sleeve 21. The guide sleeve 28 disposed at the lowest end is preferably fixedly connected to a lower end of the inner sleeve 22.

Referring to FIG. 5 and FIG. 6, the guide sleeve 28 may comprise a first guide sleeve 28-1 and a second guide sleeve 28-2. The second guide sleeve 28-2 is disposed at the lower end of the inner sleeve 22 and is fixed by a fastener, such as a pin or screw. The first guide sleeve 28-1 is slidable on the inner sleeve 22. The second guide sleeve 28-2 can effectively prevent the first guide sleeve 28-1 from falling off the inner sleeve 22 while sliding.

The guide sleeve 28 disposed between the inner sleeve 22 and the outer sleeve 21 can prevent friction between the inner sleeve 22 and the outer sleeve 21, thus protecting the surface of the inner sleeve 22.

As shown in FIG. 5, the guide sleeve 28 may include a plurality of through holes 281 in which a plurality of ball bearings 282 are embedded. The ball bearings 282 abut against the inner sleeve 22 and the outer sleeve 21. Thus, sliding friction is converted into rolling friction to reduce the overall friction.

In a specific implementation, the height adjustment mechanism 20 in the present disclosure further includes a base 25 and a mounting frame 26. The base 25 is fixed at a bottom end of the outer sleeve 21, and the mounting frame 26 is fixed at a top end of the inner sleeve 22. A gas spring 27 is provided inside the inner sleeve 22. Two ends of the gas spring 27 are separately fixed on the mounting frame 26 and the base 25. The gas spring 27 provides a lifting force to the inner sleeve 22.

Figure 7:
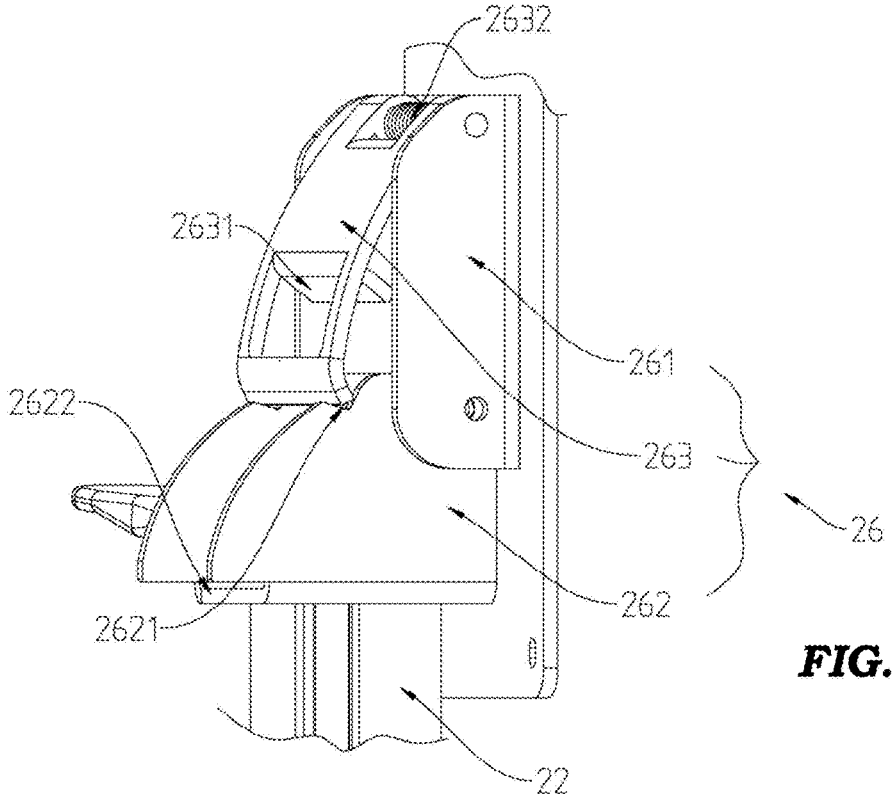
FIG. 7 is a schematic structural diagram of a mounting frame with a rotating frame in a vertical state according to an embodiment of the present disclosure.
Figure 8:
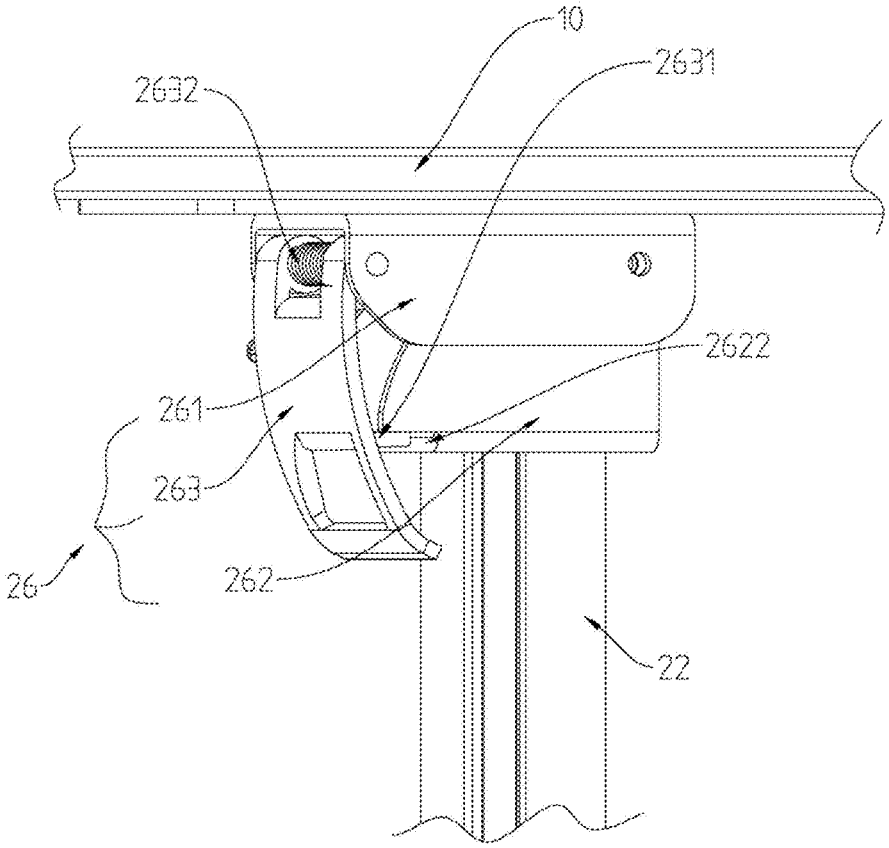
FIG. 8 is a schematic structural diagram of a mounting frame with a rotating frame in a horizontal state according to an embodiment of the present disclosure.

In some embodiments shown in FIG. 7 and FIG. 8, the mounting frame 26 includes a fixing base 262, a rotating frame 261, and a rotating handle assembly 263. The fixing base 262 is fixed at the top end of the inner sleeve 22, and an end of the rotating frame 261 is rotatably connected to the fixing base 262. An end of the rotating handle assembly 263 is rotatably connected to a free end of the rotating frame 261. The fixing base 262 includes a concave portion 2621 in which a free end of the rotating handle assembly 263 may be inserted to fix the position of the rotating handle assembly 263. When the free end of the rotating handle assembly 263 is embedded in the concave portion 2621, the rotating frame 261 is vertically disposed. The tabletop 10 is fixed on the rotating frame 261.

It should be noted that a torsion spring 2632 is disposed between the rotating handle assembly 263 and the rotating frame 261. The rotating handle assembly 263 includes an abutting block 2631. A fixing frame includes a lower embedding notch 2622 in which the abutting block 2631 may be embedded. The lower embedding notch 2622 is disposed in a bottom side of the fixing frame. When the rotating handle assembly 263 drives the tabletop 10 to swing downward, the abutting block 2631 is embedded in the lower embedding notch 2622. When the tabletop 10 is horizontally placed, the torsion spring 2632 is in a tightened state, so that the lower embedding notch 2622 abuts against the abutting block 2631 to fix the tabletop 10.

Figure 10:
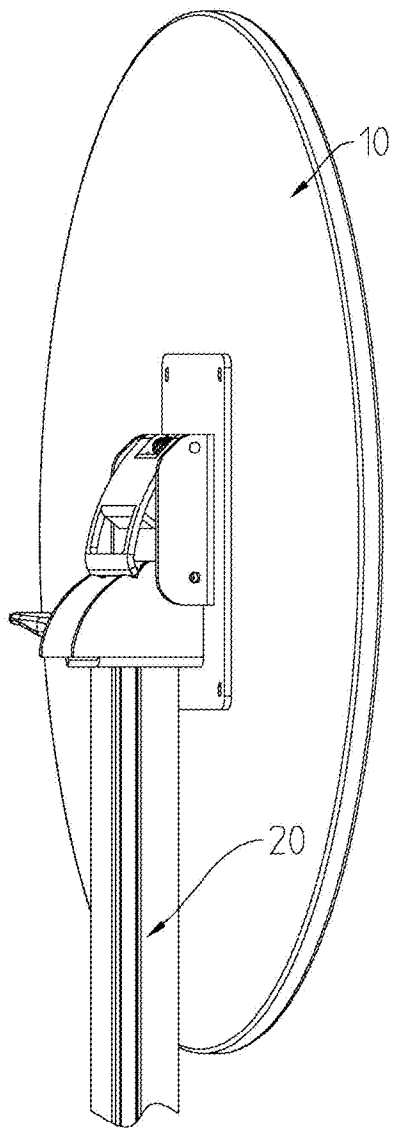
FIG. 10 depicts a table in a folded state according to an embodiment of the present disclosure.
Figure 9:
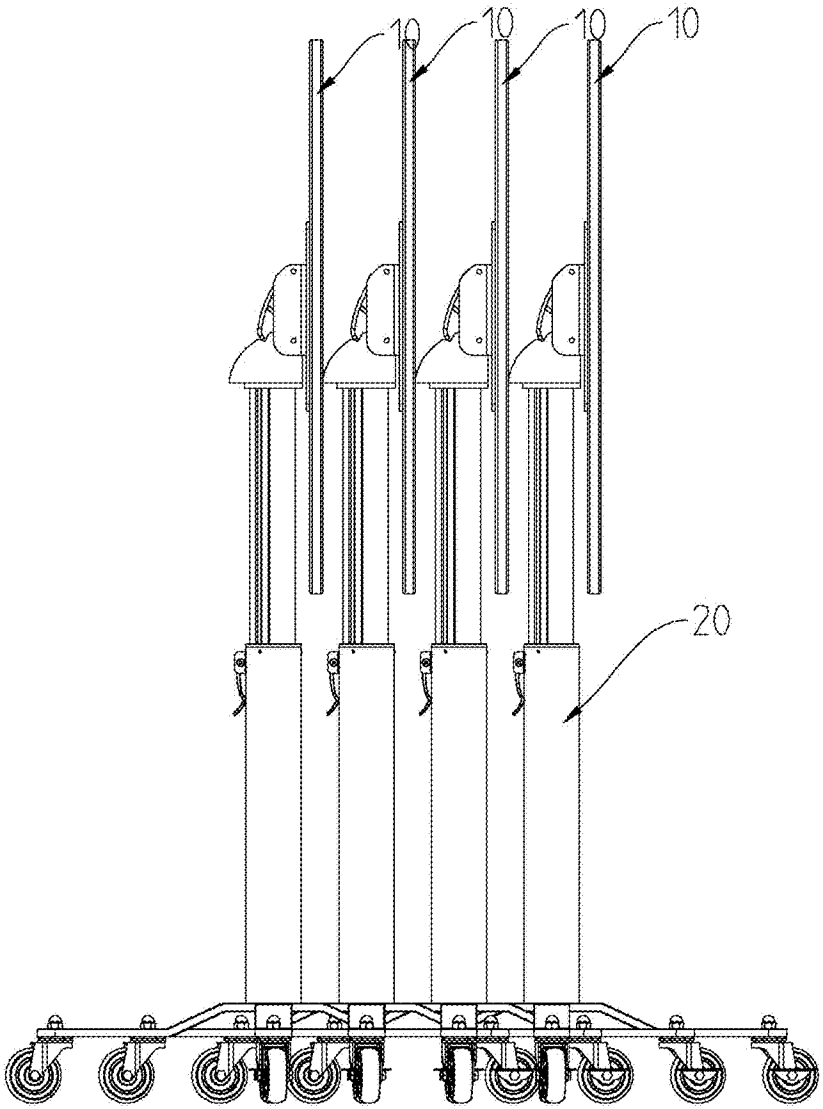
FIG. 9 depicts a plurality of tables arranged close together according to an embodiment of the present disclosure.

The rotating handle assembly 263 is rotated to manipulate the rotating frame 261 to switch between a horizontal state and a vertical state, making it convenient for a user to turn around the tabletop 10 to facilitate storage. FIG. 10 is a schematic structural diagram showing a table in a folded state. When the table is turned around and folded, horizontal space needed for storage can be reduced, thereby increasing the space utilization. Referring to FIG. 9, for storage purposes, a plurality of tables may be arranged close together to save space.

In one preferred embodiment, a table includes a tabletop 10 and a height adjustment mechanism 20. The height adjustment mechanism 20 includes an outer sleeve 21, an inner sleeve 22, a plug 23, a locking mechanism 29, a base 25, and a mounting frame 26. The outer sleeve 21 is disposed outside the inner sleeve 22. The outer sleeve 21 and the inner sleeve 22 are slidable relative to each other. The plug 23 is disposed outside the inner sleeve 22 and is slidably connected to the inner sleeve 22. The plug 23 is disposed at the upper end of the outer sleeve 21, and the outer wall of the plug 23 includes a pressing portion 231. The plug 23 is embedded in the outer sleeve 21 and is fixed on the outer sleeve 21 by a fastener, such as a pin or screw. The outer sleeve 21 includes a concave hole 211. The locking mechanism 29 includes a cam 24. The outer sleeve 21 includes a cam base 241. The cam base 241 includes stop blocks disposed on two sides of the concave hole 211. The cam 24 is rotatably connected to the stop blocks. The cam 24 rotates on the cam base 241 and extends into the concave hole 211. The cam 24 drives the pressing portion 231 to press against the inner sleeve 22, and the friction between the pressing portion 231 and the inner sleeve is increased to fix the positions of the plug 23 and the inner sleeve relative to each other. A plurality of protrusions 232 are disposed at an inside surface of the plug 23, and a plurality of grooves 221 are disposed at the surface of the inner sleeve 22 for accommodating the protrusions 232. At least one guide sleeve 28 is disposed between the inner sleeve 22 and the outer sleeve 21. The guide sleeve 28 at the lowest end is fixedly connected to a lower end of the inner sleeve. The guide sleeve 28 includes a plurality of through holes 281 in which a plurality of ball bearings 282 are embedded. The ball bearings 282 abut against the inner sleeve 22 and the outer sleeve 21. The base 25 is fixed at a bottom end of the outer sleeve 21. The mounting frame 26 is fixed at a top end of the inner sleeve 22. A gas spring 27 is disposed inside the inner sleeve 22. Two ends of the gas spring 27 are separately fixed on the mounting frame 26 and the base 25.

The appearances of the plug 23 and the guide sleeve 28 are also configured to be aesthetically pleasing and include various ornamental aspects and features.

Figure 12:
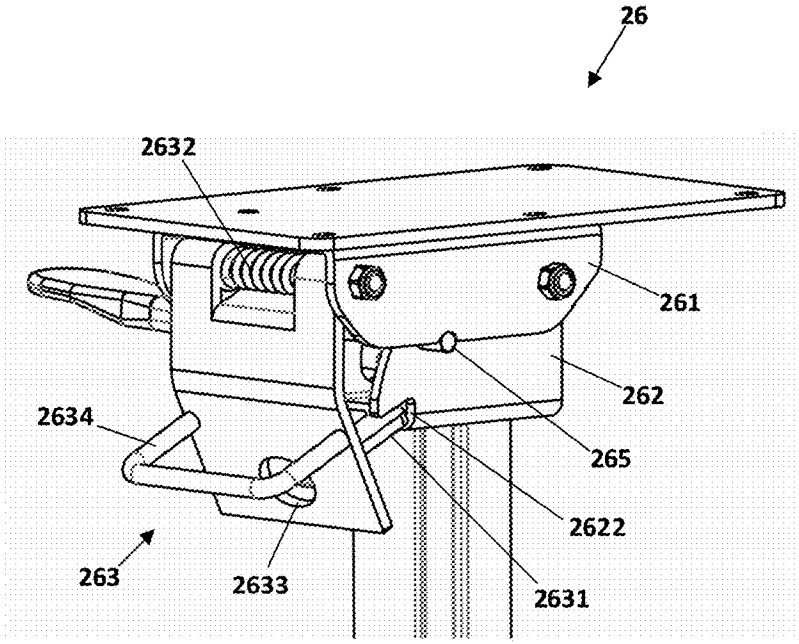
FIG. 12 is a schematic structural diagram of a mounting frame with a rotating frame in a horizontal state according to the alternative embodiment.
Figure 11:
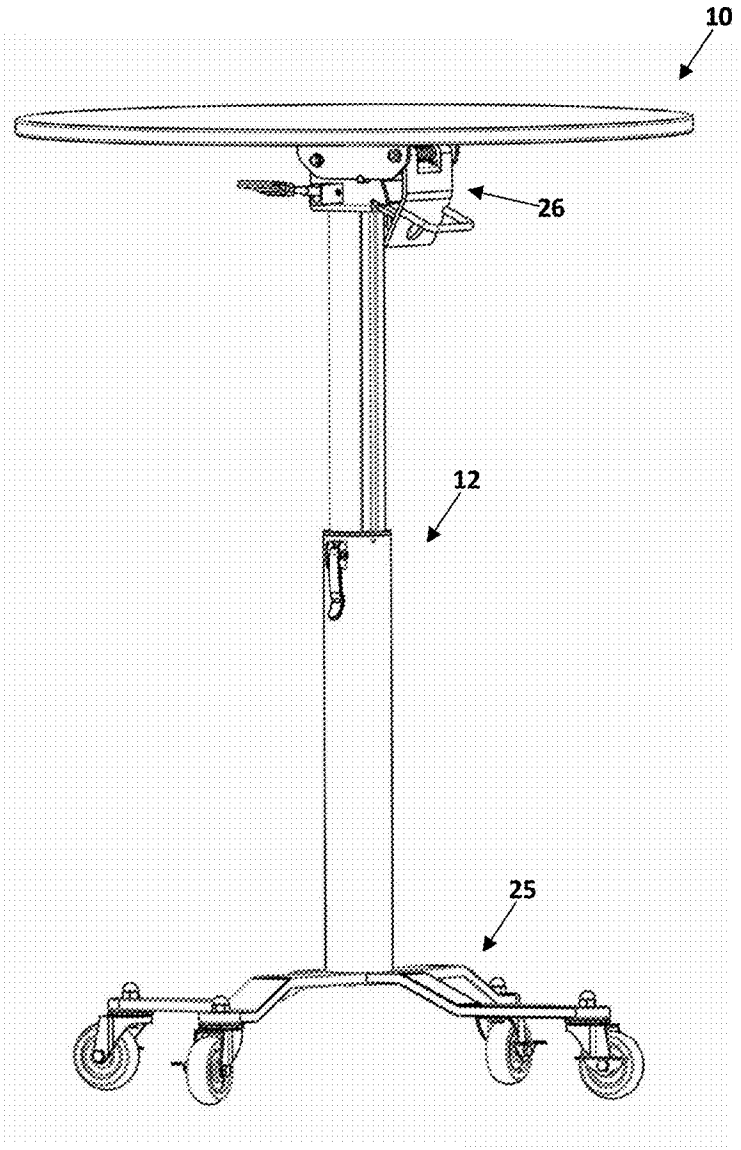
FIG. 11 depicts a schematic structural diagram of a table according to an alternative embodiment.

FIGS. 11-16 depict a height adjustable table according to an alternative embodiment. Generally, this alternative embodiment of the table is substantially the same as the previously described embodiment, except for differences in the structure of the mounting frame 26 that rotatably connects the tabletop 10 to the vertical support 12. As depicted in FIGS. 12, 13A, and 13B, the rotating handle assembly 263 of the alternative embodiment includes an outwardly-extending U-shaped handle 2634. The U-shaped handle 2634 is preferably constructed from metal and is welded to the rotating handle assembly 263.

Similar to the previously described embodiment, the rotating handle assembly 263 of the alternative embodiment includes an abutting block 2631. The abutting block 2631 of the alternative embodiment extends inwardly from the rotating handle assembly 263 in a direction that is substantially parallel to the outwardly-extending U-shaped handle 2634. In this configuration, the abutting block 2631 engages the fixing base 262 at a steeper angle than does the abutting block 2631 of the previously described embodiment. Also, the lower embedding notch 2622 is recessed into the fixing frame 262 at a steeper angle for receiving and securing the abutting block 2631 when the rotating frame 261 is in the horizontal position, as shown in FIGS. 12 and 13B. Similar to the previously described embodiment, when the tabletop 10 and rotating frame 261 are in the horizontal position, the torsion spring 2632 is in a tightened state, urging the abutting block 2631 to abut against the lower embedding notch 2622 to secure the tabletop 10 in the horizontal position. The abutting block 2631 is preferably constructed from metal and is welded to the rotating handle assembly 263.

Figure 14:
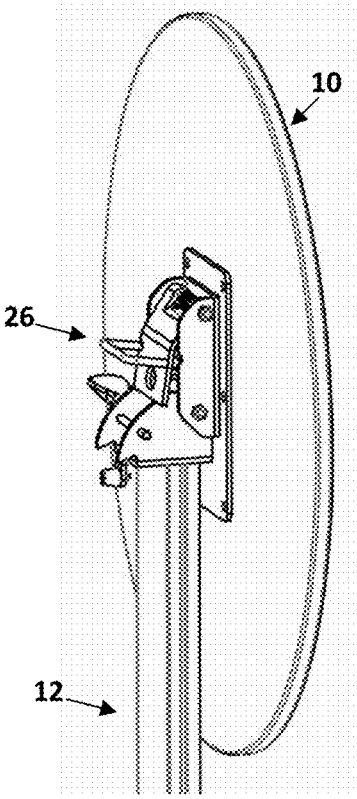
FIG. 14 depicts a table in a folded state according to the alternative embodiment.
Figure 15:
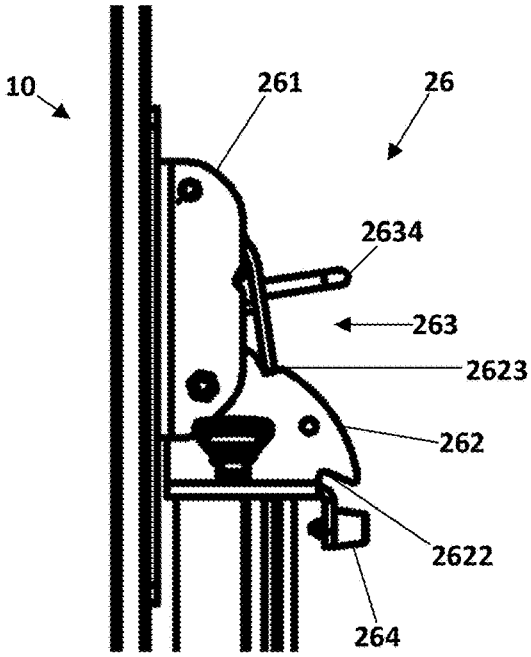
FIG. 15 depicts a side view of the mounting frame of a table in a folded state according to the alternative embodiment.

As shown in FIGS. 14 and 15, when the tabletop 10 and rotating frame 261 are rotated to the vertical position for storage, the torsion spring 2632 urges the bottom edge of the rotating handle assembly to abut against the upper embedding notch 2623 to secure the tabletop 10 in the vertical position.

Figure 13A:
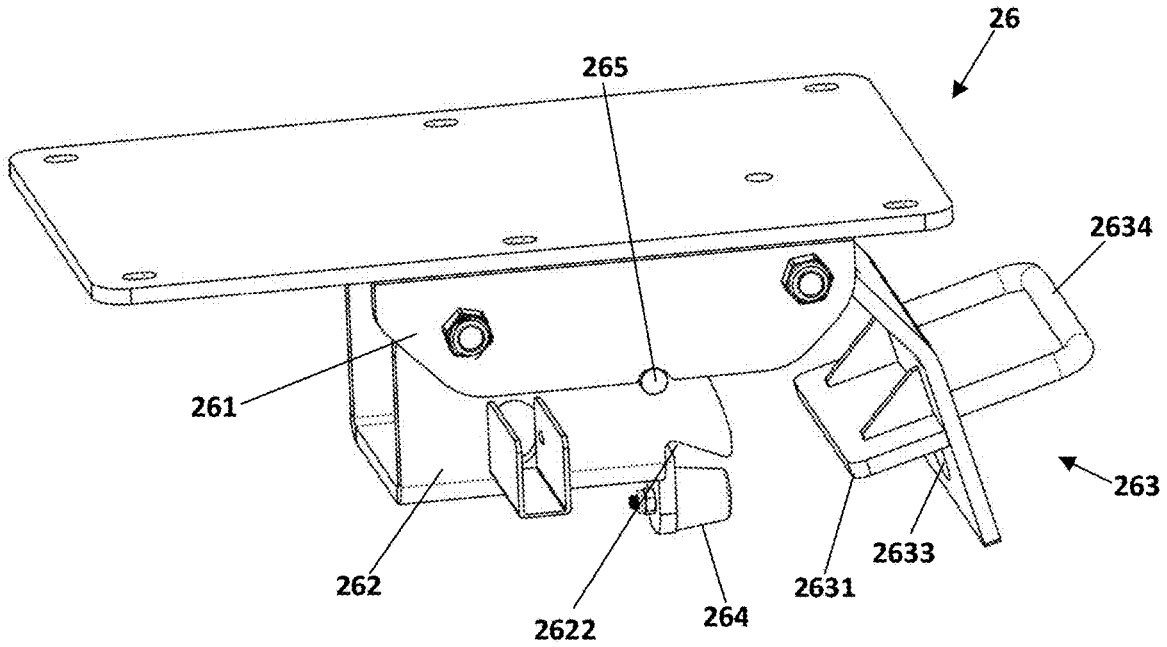
FIGS. 13A and 13B are structural diagrams of the rotating frame of FIG. 12 in a horizontal state with a rotating handle assembly in two different positions according to the alternative embodiment.
Figure 13B:
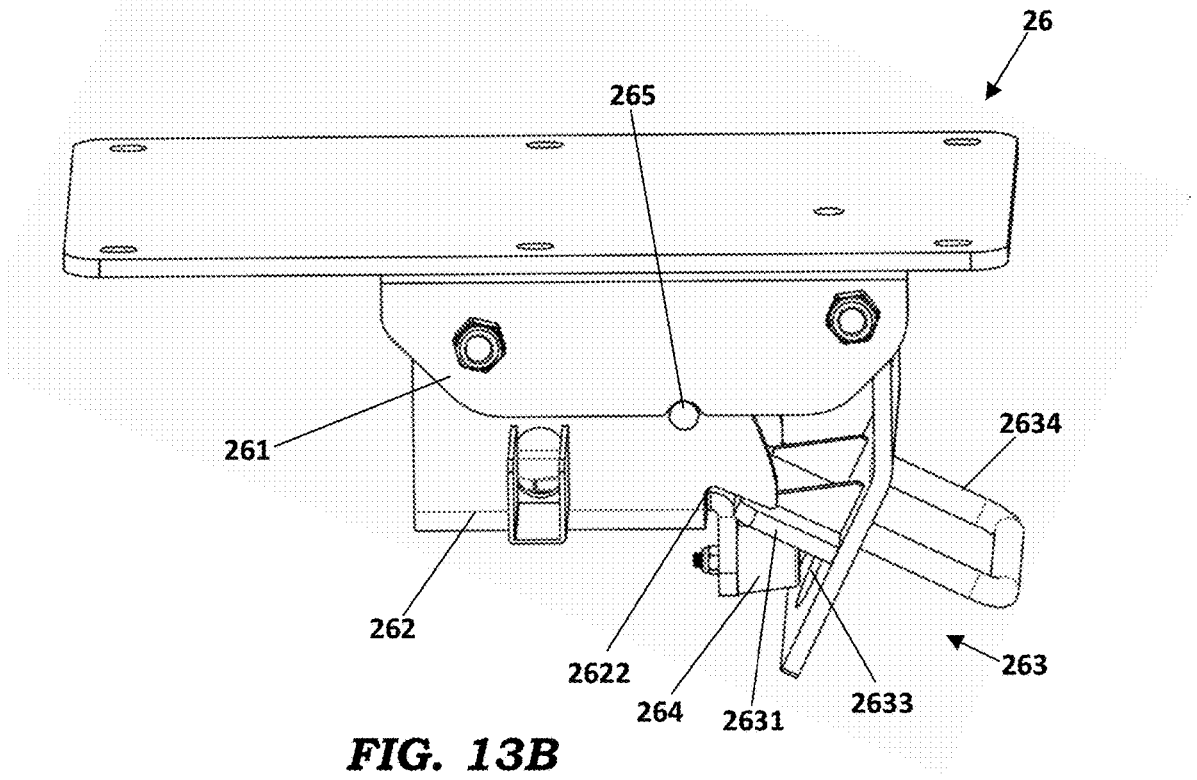
Figure 16:
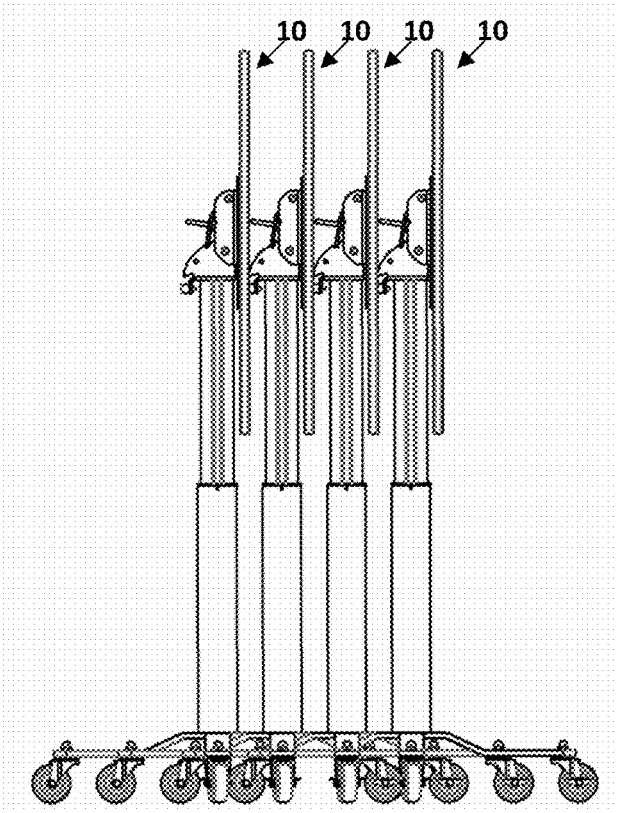
FIG. 16 depicts a plurality of tables in the folded state and arranged close together according to the alternative embodiment.

As shown in FIGS. 12, 13A, and 13B, the mounting frame 26 of the alternative embodiment also includes a bumper 264 secured to the fixing frame 262. The bumper 264 prevents the fixing frame 262 from banging against and marring the vertical surface of a tabletop 10 of an adjacent table when multiple tables are arranged close together to save space, as shown in FIG. 16. The rotating handle assembly 263 of the alternative embodiment includes a circular bumper aperture 2633 for receiving the bumper 264 when the rotating handle assembly 263 is engaged with the fixing frame 262, as shown in FIG. 13B.

As shown in FIGS. 12, 13A, and 13B, the mounting frame 26 of the alternative embodiment preferably includes stop pins 265 disposed on opposite sides of the fixing frame 262. The stop pins 265 engage corresponding notches on the bottom edges of the rotating frame 261 to prevent the rotating frame 261 from rotating beyond the horizontal position.

The foregoing description of preferred embodiments for this invention have been presented for purposes of illustration and description. They are not intended to be exhaustive or to limit the invention to the precise form disclosed. Obvious modifications or variations are possible in light of the above teachings. The embodiments are chosen and described in an effort to provide the best illustrations of the principles of the invention and its practical application, and to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally, and equitably entitled.

What is claimed is:

1. A table comprising:

a tabletop;

a vertical support disposed below the tabletop;

a mounting frame disposed at a top end of the vertical support and attached to a lower surface of the tabletop, the mounting frame comprising:

a fixing base attached to the top end of the vertical support, the fixing base having an upper embedding notch and a lower embedding notch;

a rotating frame attached to the lower surface of the tabletop and rotatably connected to the fixing base, the rotating frame operable to rotate between a horizontal position and a vertical position;

a rotating handle assembly that is rotatably connected to the rotating frame, the rotating handle assembly comprising:

an abutting block extending inwardly from the rotating handle assembly that engages the lower embedding notch in the fixing base when the rotating frame is in the horizontal position;

a lower edge that engages the upper embedding notch in the fixing base when the rotating frame is in the vertical position; and a handle extending outwardly from the rotating handle assembly, the handle configured to be operated by a user to move the rotating frame between the vertical position and the horizontal position; and a bumper attached to the fixing base to prevent damage to an adjacent vertically-disposed tabletop when multiple tables are stored together in close proximity with their tabletops rotated to vertical positions.

2. The table of claim 1 wherein the rotating handle assembly further comprises a torsion spring disposed at a connection between the rotating handle assembly and the rotating frame, the torsion spring for urging the abutting block into engagement with the lower embedding notch when the rotating frame is in the horizontal position, and for urging the lower edge of the rotating handle assembly into engagement with the upper embedding notch when the rotating frame is in the vertical position.

3. The table of claim 1 further comprising an aperture in the rotating handle assembly for receiving the bumper when the abutting block is engaged with the lower embedding notch in the fixing base.

4. The table of claim 1 further comprising one or more stop pins disposed on the fixing base for engaging one or more corresponding notches on a bottom edge of the rotating frame, the one or more stop pins for preventing the rotating frame from rotating beyond the horizontal position.

5. A table comprising:

a tabletop;

a vertical support disposed below the tabletop;

a mounting frame disposed at a top end of the vertical support and attached to a lower surface of the tabletop, the mounting frame comprising:

a fixing base attached to the top end of the vertical support, the fixing base having an upper embedding notch and a lower embedding notch;

a rotating frame attached to the lower surface of the tabletop and rotatably connected to the fixing base, the rotating frame operable to rotate between a horizontal position and a vertical position; and a rotating handle assembly that is rotatably connected to the rotating frame, the rotating handle assembly comprising:

an abutting block extending inwardly from the rotating handle assembly that engages the lower embedding notch in the fixing base when the rotating frame is in the horizontal position;

a lower edge that engages the upper embedding notch in the fixing base when the rotating frame is in the vertical position;

a handle extending outwardly from the rotating handle assembly, the handle configured to be operated by a user to move the rotating frame between the vertical position and the horizontal position; and a torsion spring disposed at a connection between the rotating handle assembly and the rotating frame, the torsion spring for urging the abutting block into engagement with the lower embedding notch when the rotating frame is in the horizontal position, and for urging the lower edge of the rotating handle assembly into engagement with the upper embedding notch when the rotating frame is in the vertical position;

one or more stop pins disposed on the fixing base for engaging one or more corresponding notches on a bottom edge of the rotating frame, the one or more stop pins for preventing the rotating frame from rotating beyond the horizontal position; and a bumper attached to the fixing base to prevent damage to an adjacent vertically-disposed tabletop when multiple tables are stored together in close proximity with their tabletops rotated to vertical positions, wherein the rotating handle assembly includes an aperture for receiving the bumper when the abutting block is engaged with the lower embedding notch in the fixing base.

6. A table comprising:

a tabletop;

a vertical support disposed below the tabletop;

a mounting frame disposed at a top end of the vertical support and attached to a lower surface of the tabletop, the mounting frame comprising:

a fixing base attached to the top end of the vertical support, the fixing base having an upper embedding notch and a lower embedding notch;

a rotating frame attached to the lower surface of the tabletop and rotatably connected to the fixing base, the rotating frame operable to rotate between a horizontal position and a vertical position; and a rotating handle assembly that is rotatably connected to the rotating frame, the rotating handle assembly comprising:

an abutting block extending inwardly from the rotating handle assembly that engages the lower embedding notch in the fixing base when the rotating frame is in the horizontal position;

a lower edge that engages the upper embedding notch in the fixing base when the rotating frame is in the vertical position; and a handle extending outwardly from the rotating handle assembly, the handle configured to be operated by a user to move the rotating frame between the vertical position and the horizontal position; and a bumper attached to the mounting frame to prevent damage to an adjacent vertically-disposed tabletop when multiple tables are stored together in close proximity with their tabletops rotated to vertical positions.

* * * * *